US009038297B1

(12) United States Patent
Theobald, III

(10) Patent No.: US 9,038,297 B1
(45) Date of Patent: May 26, 2015

(54) SELF-RIGHTING, ROCKING DISPLAY SYSTEM

(71) Applicant: C. J. Theobald, III, Louisville, KY (US)

(72) Inventor: C. J. Theobald, III, Louisville, KY (US)

( * ) Notice: Subject to any disclaimer, the term of this patent is extended or adjusted under 35 U.S.C. 154(b) by 0 days.

(21) Appl. No.: 13/909,169

(22) Filed: Jun. 4, 2013

Related U.S. Application Data

(60) Provisional application No. 61/669,447, filed on Jul. 9, 2012.

(51) Int. Cl.
*E01F 9/017* (2006.01)
*G09F 7/00* (2006.01)
*G09F 7/22* (2006.01)

(52) U.S. Cl.
CPC .. *E01F 9/017* (2013.01); *G09F 7/22* (2013.01)

(58) Field of Classification Search
CPC ..... E04B 1/34347; E01F 9/045
USPC ..... 40/608; 404/10, 11; 248/499, 509
See application file for complete search history.

(56) References Cited

U.S. PATENT DOCUMENTS

| | | | | |
|---|---|---|---|---|
| 664,871 | A | 1/1901 | Keyser | |
| 1,420,603 | A | 6/1922 | Zimmerli | |
| 1,443,204 | A * | 1/1923 | Bernstein | 40/608 |
| 1,452,396 | A | 4/1923 | Sterner | |
| 3,341,958 | A | 9/1967 | Pardue | |
| 3,478,714 | A * | 11/1969 | Keats | 116/63 R |
| 4,117,455 | A | 9/1978 | Cervantes | |
| 4,553,346 | A | 11/1985 | Glasener | |
| 7,377,717 | B2 * | 5/2008 | Clark et al. | 404/10 |
| 2006/0076857 | A1 | 4/2006 | Hsieh | |
| 2013/0022396 | A1 * | 1/2013 | Hannah et al. | 404/10 |

FOREIGN PATENT DOCUMENTS

| | | |
|---|---|---|
| GB | 2308913 | 9/1997 |

* cited by examiner

*Primary Examiner* — Joanne Silbermann
(74) *Attorney, Agent, or Firm* — Camoriano and Associates

(57) ABSTRACT

A display system that rocks in the wind and is self-righting with a biased anchoring system that is recessed inside of the display and hidden from view.

11 Claims, 16 Drawing Sheets

SELF-RIGHTING, ROCKING DISPLAY SYSTEM

This application claims priority from U.S. Provisional Application Ser. No. 61/669,447 filed Jul. 9, 2012.

BACKGROUND

The present invention relates to a display system which is intended to rest on a flat ground support surface, such as a sidewalk, where a breeze may be used advantageously to rock the display in order to attract attention to the message on the display.

SUMMARY

An embodiment of the present invention provides a display mounted on a convex base, which is internally tethered to an anchoring system. The anchoring/tethering system is enclosed by the base and base cover. This enclosed anchoring/tethering system has several advantages. It prevents the display from "walking away" on its own as it is rocked by the wind and helps prevent unauthorized removal of the display. It also includes a biasing mechanism, such as a spring, wherein the spring constant may be selected to control the degree to which the display will rock when acted on by an outside force such as a breeze, and to provide for the display to right itself after it has been displaced. A plurality of different covers may be secured to the base in order to accommodate a plurality of different display configurations.

DESCRIPTION

Figure 1:
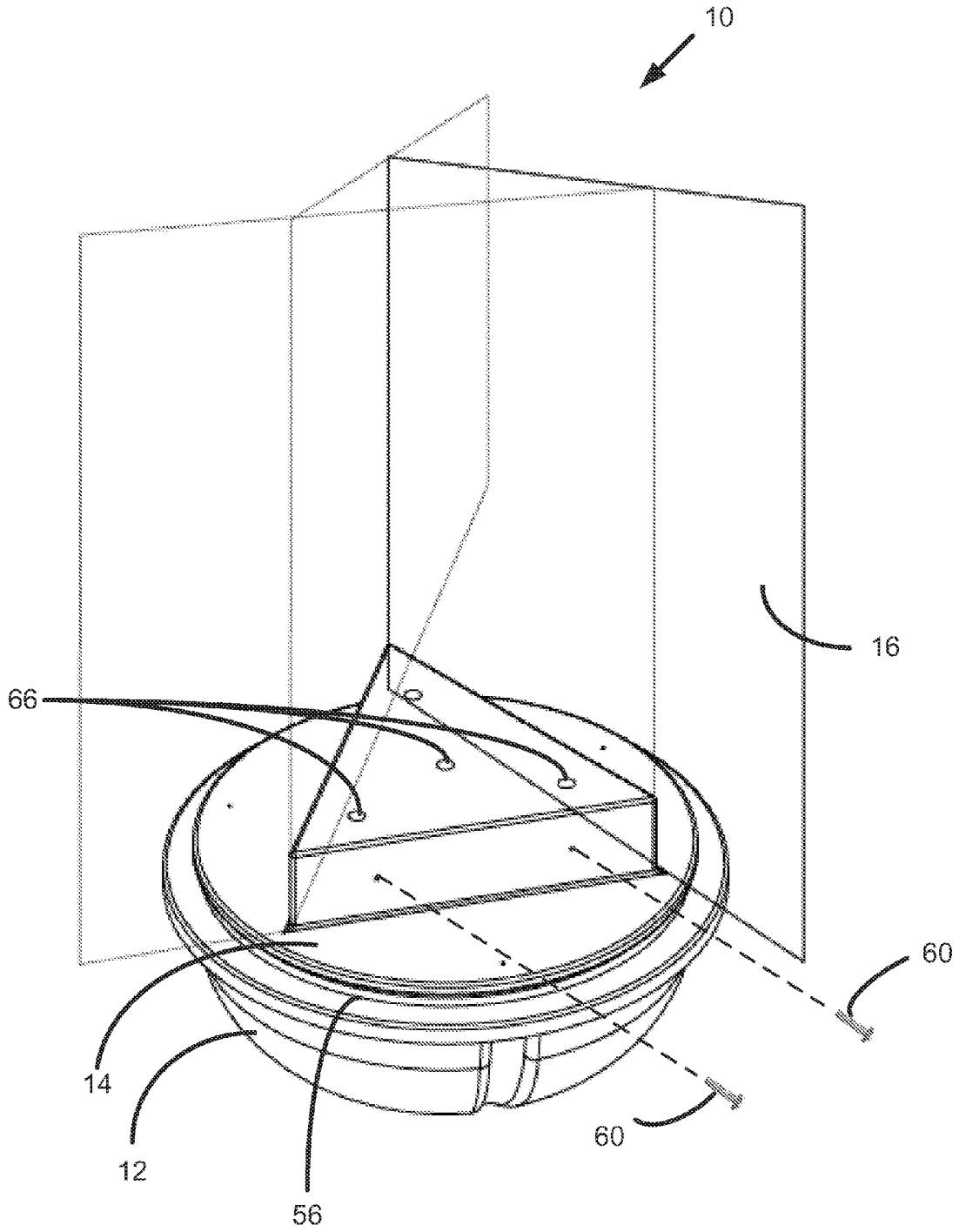
FIG. 1 is a perspective view of one embodiment of a display.

FIGS. 1-31 show various embodiments of a self-righting, rocking display system 10. Referring to FIG. 1, the display system 10 includes a base 12, a releasable cover 14 mounted on top of the top edge of the base, and one or more displays 16 releasably secured to the cover 14. In various alternative arrangements, different covers and displays are mounted on top of the base 12.

The wall of the base 12 has a convex bottom surface, which is shaped to allow the base 12 to rock when it is resting on the ground or some other flat ground support surface, such as a sidewalk. The wall of the base 12 defines a hollow cavity 64, which is enclosed by the releasable cover 14.

Figure 2:
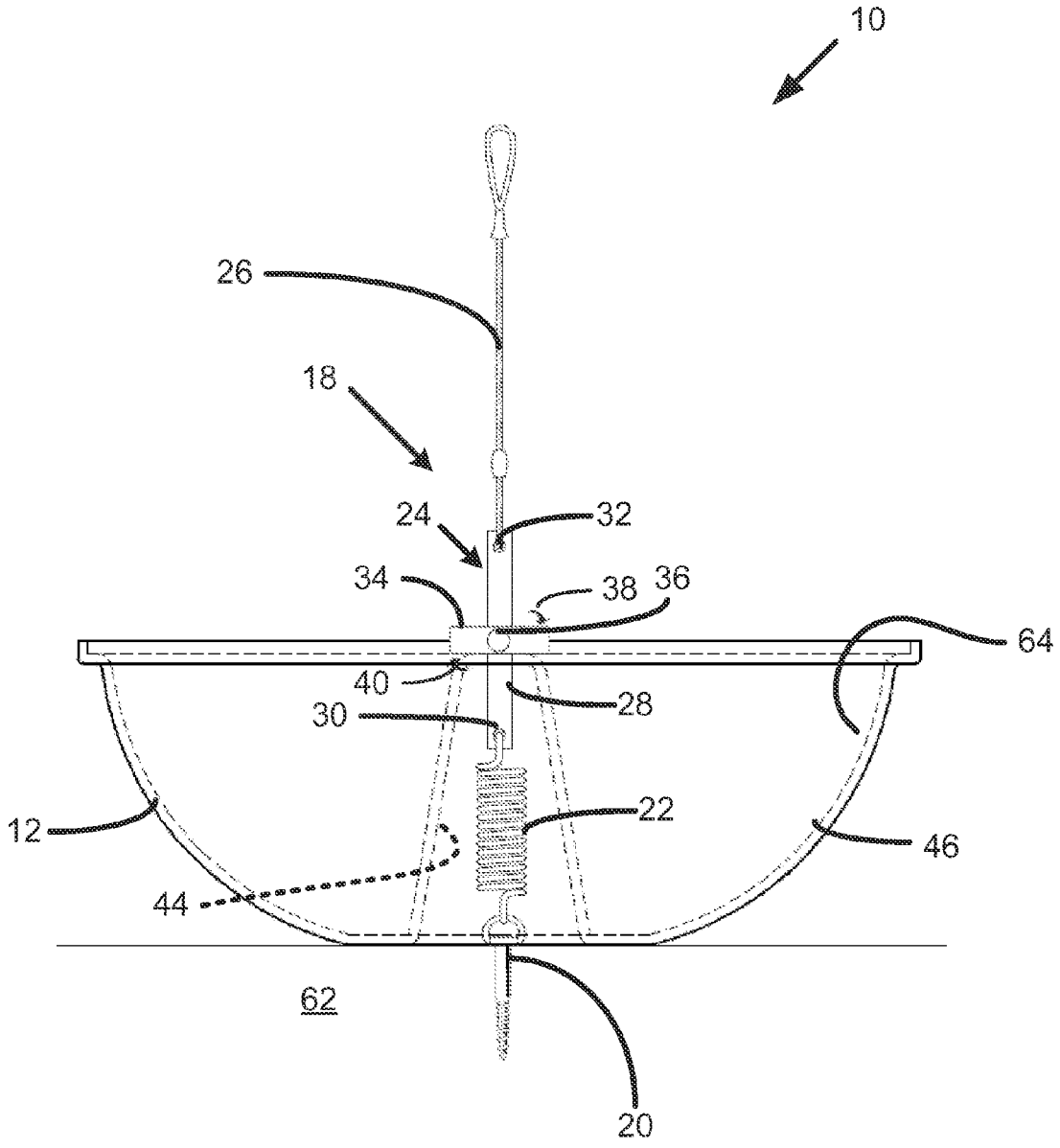
FIG. 2 is a side view, partially in section, of the base portion of the display of FIG. 1, including a biased anchor member which secures the display to a fixed anchoring device.

FIG. 2 shows an anchor-and-tether system 18, which secures the base 12 to keep it in place, to regulate the amount of rocking, and to provide the self-righting capability to the display system 10, as will be described in more detail later.

Figure 4:
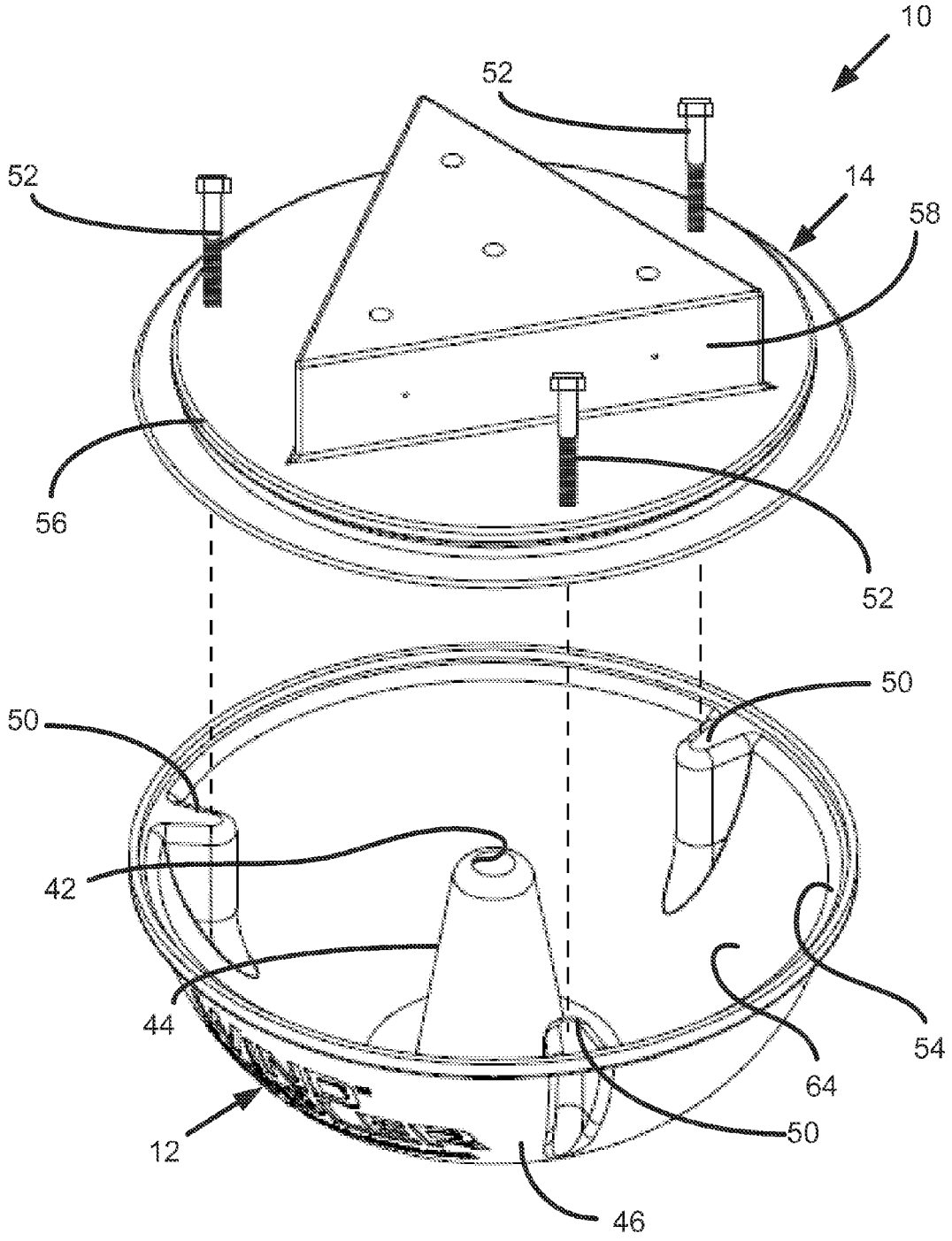
FIG. 4 is an exploded perspective view of the base and cover of FIG. 2.

Referring now to FIGS. 2 and 4, the bottom surface of the base 12 has a central portion which has a large radius of curvature so that it is essentially flat. That central portion is surrounded by side portions 46 having a smaller radius of curvature, so the side portions 46 are more curved than the central portion. In this embodiment, the base 12 is essentially a hemisphere with a somewhat flattened center bottom portion. (Other convex, arcuate shapes suitable for rocking could be used instead of a hemispherical shape, such as an ellipsoidal shape, for example. Also, the shape of the bottom surface could be such that it permits rocking in one direction and not in another.) The base also has a wall 44, which defines a recess at the bottom center. The wall 44 has a frusto-conical shape and is open at the top 42 and at the bottom, with the bottom end having a larger diameter and tapering to a smaller diameter at the top.

Three internally-projecting bosses 50 are located at equally spaced intervals along the upper perimeter of the base 12. These bosses 50 are threaded and receive screws 52 to releasably secure the cover 14 to the base 12. Of course, the cover 14 may be secured to the base 12 via other means, such as by providing mating threads on the cover and base and threading the cover 14 onto the base 12 (similar to the lid on a jar), for instance. A lip 54 on the top edge of the base 12 helps in aligning the cover 14 to the base 12.

The use of screws 52 discourages the unauthorized access to the anchor-and-tether system 18. Screws with customized tamper-resistant heads requiring a special tool for driving the screws, such as star-shaped heads or other special shaped heads (not shown) may be used to help ensure that only authorized personnel can access the interior hollow cavity 64 of the base 12 to disassemble the anchor-and-tether system 18 and remove the display system 10.

Figure 28:
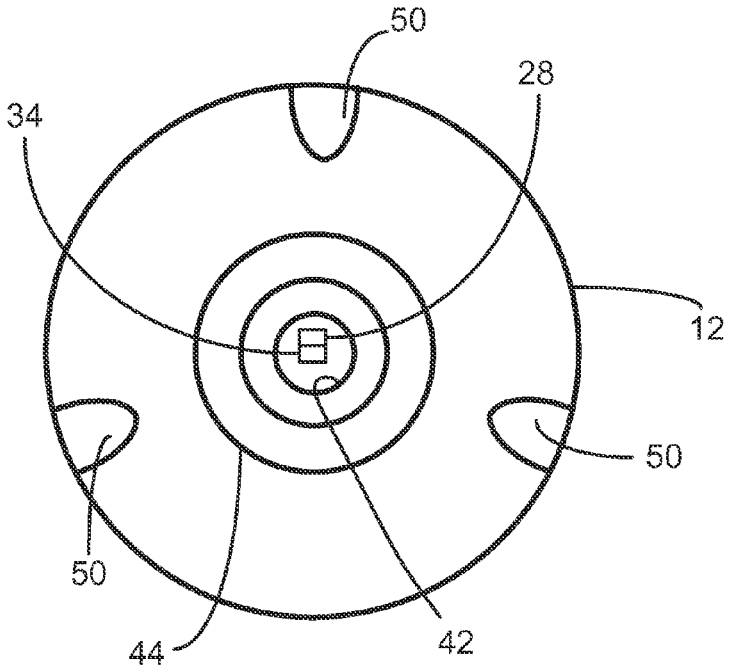
FIG. 28 is a schematic plan view of the base and the anchor and tether arrangement of FIG. 2, with the adjustable cross-piece oriented substantially parallel to the vertical element of the tether to allow the tether arrangement to be installed through an opening in the base.
Figure 29:
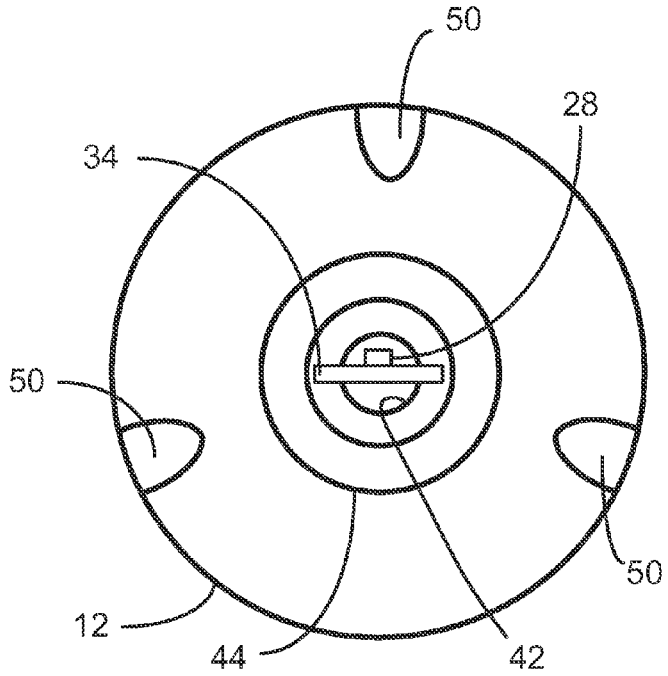
FIG. 29 is a schematic plan view, similar to FIG. 28, but with the adjustable cross-piece oriented substantially perpendicular to the vertical element of the tether to releasably secure the tether arrangement to the base.

The anchor and tether system 18 includes a fixed anchor 20, which is fixed relative to the ground. In the embodiment of FIG. 2, the fixed anchor 20 is an eye bolt with wood screw threads, which secure the fixed anchor 20 to a wooden ground support surface, such as a wooden deck 62. The fixed anchor 20 includes a threaded portion which is screwed into the ground and an eye which is recessed into the cavity 44 of the base 12 when the display system 10 is in an upright position. The tether system includes a biased anchor member, which in this embodiment is a spring 22. It also includes a pivotable cross-piece 24 and a cable 26. The pivotable cross-piece 24 includes a first, vertical, elongated member 28 which defines through openings 30, 32 adjacent to the ends of the elongated member 28. The through opening 30 receives one end of the spring 22, and the through opening 32 receives one end of the cable 26. A second elongated member 34 is pivotably mounted to the first elongated member 28, intermediate the two openings 30, 32. As explained in more detail later, the second elongated member 34 is a rigid piece that pivots about a horizontal pivot axis 36 relative to the first elongated member 28 as shown by the arrows 38, 40. The second elongated member 34 pivots from a vertical position, in which it is aligned with the first elongated member 28, to a horizontal position in which it is perpendicular to the first elongated member 28, as shown in FIGS. 2 and 29, in order to secure the base 12 to the fixed anchor 20. As shown in FIG. 28, when the second elongated member 34 is in a vertical position, aligned with the first elongated member 28, the biased anchoring member 22 is secured at its bottom end to the fixed anchor 20 by hooking the end of the member 22 through the eye of the fixed anchor 20. Then the cable 26 is inserted through the opening 42, and a person pulls on the free end of the cable 26, pulling the cross-piece 24 upwardly through the opening 42 (See FIG. 4) in the base 12 and stretching the biased anchoring member 22 until the second elongated member 34 passes completely through the opening 42. Then, the second elongated member 34 is pivoted to the horizontal position and the cable 26 is released. When the second elongated member 34 is in the horizontal position, it is too long in the horizontal direction to fit through the opening 42, so it abuts the top edge of the wall 44 at the top opening 42. The spring 22 then maintains a tension between the cross-piece 24 and the fixed anchor 20, pulling the second elongated member 34 against the top edge of the wall 44 of the base 12 and pulling against the fixed anchor 20 in order to secure the base 12 to the fixed anchor 20.

Figure 3:
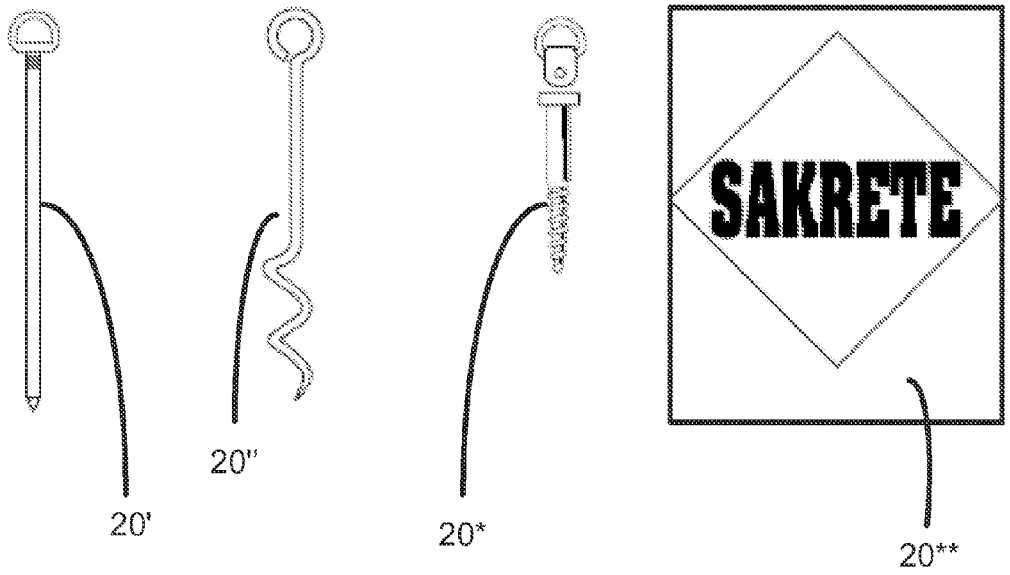
FIG. 3 is a schematic showing various fixed anchoring devices which may be used instead of, or in addition to, the fixed anchoring device of FIG. 2.
Figure 30:
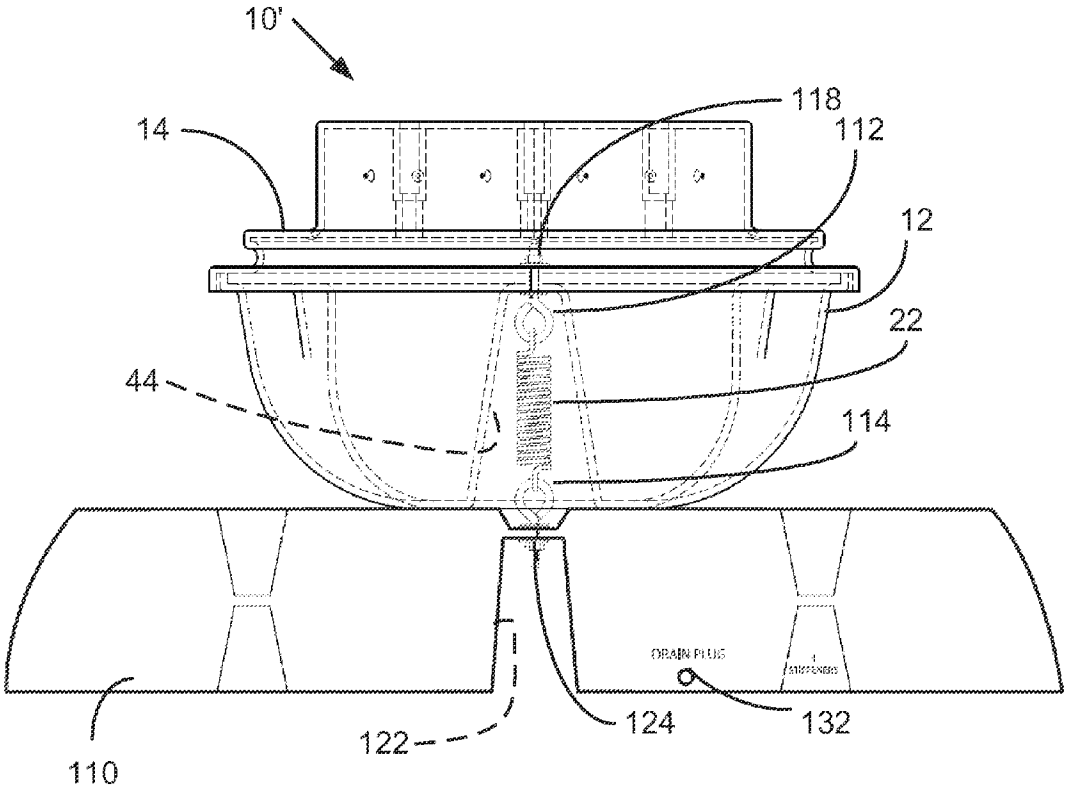
FIG. 30 is a section view of the base and cover, similar to FIG. 5, but using a different type of fixed anchor.

Referring briefly to FIG. 3, the fixed anchor 20 may be replaced by other optional anchoring devices depending on the application and limitations of the installation. For instance, the anchor 20 of FIG. 2, suitable for anchoring into wooden surfaces, may be replaced by the ground spike 20' (for use in firm soil and asphalt), or by the ground screw 20" (suitable for use in soft, loose soils), or by the ground bolt 20* (for use in concrete and asphalt), or by a ballast system 20, such as the SAKRETE® depicted (for use when a hole for securing an anchor is not an option). Another alternative anchor 110 is shown in FIG. 30**. Of course, more than one of the anchors described may be used if desired.

The top portion of FIG. 4 shows one type of cover 14, which mounts on top of the base 12. An upwardly-projecting, cylindrical lip 56 on the cover 14 may be used to secure a display to the cover 14, as shown later. The cover 14 defines a triangular projection 58, which projects upwardly and which may be used to secure displays 16 to the cover 14, as explained below. The triangular projection 58 is a hollow, relatively thin wall, so it provides clearance to accommodate the upper portion of the pivotable cross-piece 24. (The cable 26 may be stowed in the cavity 64 of the base 12 when not in use.) The lower portion of the pivotable cross-piece 24 as well as the spring 22 and the eye-bolt portion of the fixed anchor 20 are fully enclosed within the frusto-conical recess wall 44, as shown in FIG. 2. Thus, the cover 14 and the base 12 function together to enclose and hide the anchor-and-tether system 18. This makes the anchor-and-tether system 18 essentially inaccessible from outside the display system once the cover 14 is installed on the base 12 and the display system is secured to a fixed anchor.

Referring to FIG. 1, displays 16, such as flat panels 16 made out of corrugated plastic (also commonly referred to as COROPLAST® displays), may be secured to the sides of the triangular projection 58, using screws 60 which pass through the panels 16 and through the walls of the projection 58. Alternative fasteners, such as bolts, or other known fasteners, could be used, as desired.

To assemble the display system 10, the fixed anchor 20 is first secured to the ground support (in this case, a wooden deck 62, See FIG. 2). The rest of the anchor-and-tether system 18 is secured to the fixed anchor 20, the cable 26 is pulled vertically (as shown in FIG. 2), and the second elongated member 34 of the pivotable cross-piece 24 is pivoted so that it is substantially parallel to the first elongated member 28. The base 12 is then dropped over the anchor and tether system 18, with the cable 26 projecting through the opening 42 in the frusto-conical indentation 44 of the base 12.

The cable 26 is pulled upwardly to stretch the spring 22 until the second elongated member 34 has fully cleared the opening 42 of the frusto-conical indentation 44. While pulling on the handle of the cable 26 and holding the spring 22 in tension, the second elongated member 34 is now pivoted so that it is substantially perpendicular to the first elongated member 28. Releasing the cable 26 results in the second elongated member 34 resting across and atop the opening 42 of the frusto-conical indentation 44, which secures the base 12 to the anchor-and-tether system 18 with at least some residual tension remaining on the spring 22. Once the base 12 is secured to the tethering system 18, the cable 26 may be removed or stowed inside the hollow interior of the base 12.

It should be noted that the spring 22 may be selected to provide the desired degree of stiffness to control the amount of rocking that the display system 10 will exhibit depending on the strength of the wind gusts and the amount of surface area that the display(s) 16 attached to the cover 14 present to the wind. The position of the second elongated member 34 relative to the first elongated member 28 may also be adjusted (this feature is not shown but may be accomplished, for instance, by having a number of holes along the first elongated member 28 and selecting the desired one of the holes to insert the pivot axle 36 in order to adjust the amount of tension on the spring 22, as desired.

Figure 5:
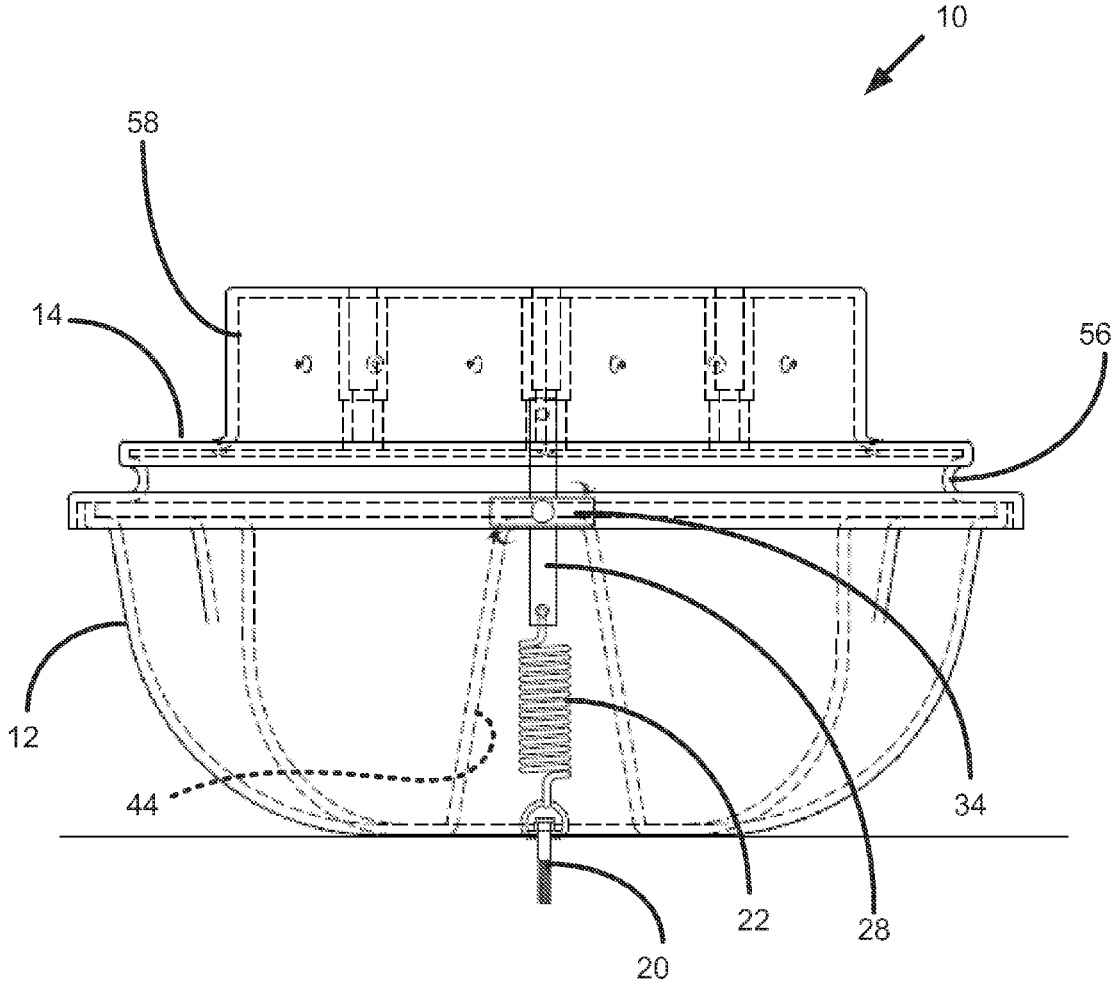
FIG. 5 is a section view similar to FIG. 2, but with the cover installed on top of the base.
Figure 8:
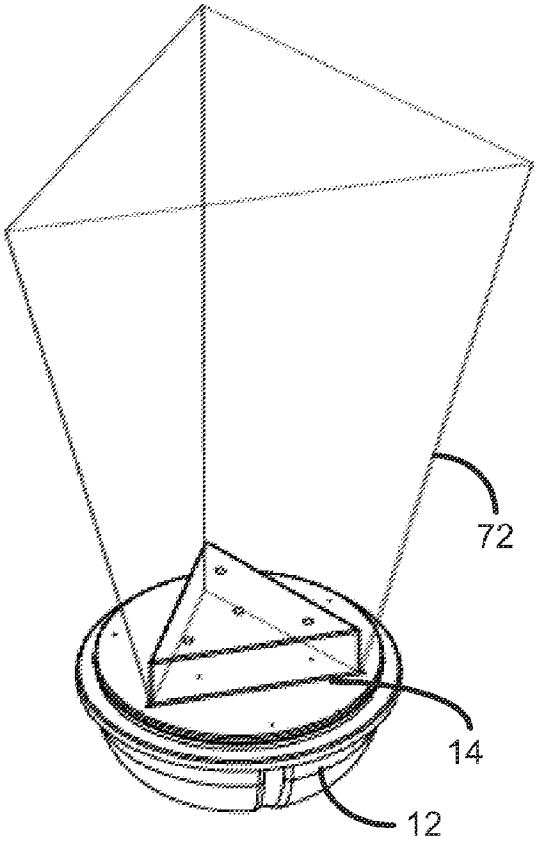
FIG. 8 is the same as FIG. 7 but with a differently-shaped display mounted on the base and cover.
Figure 7:
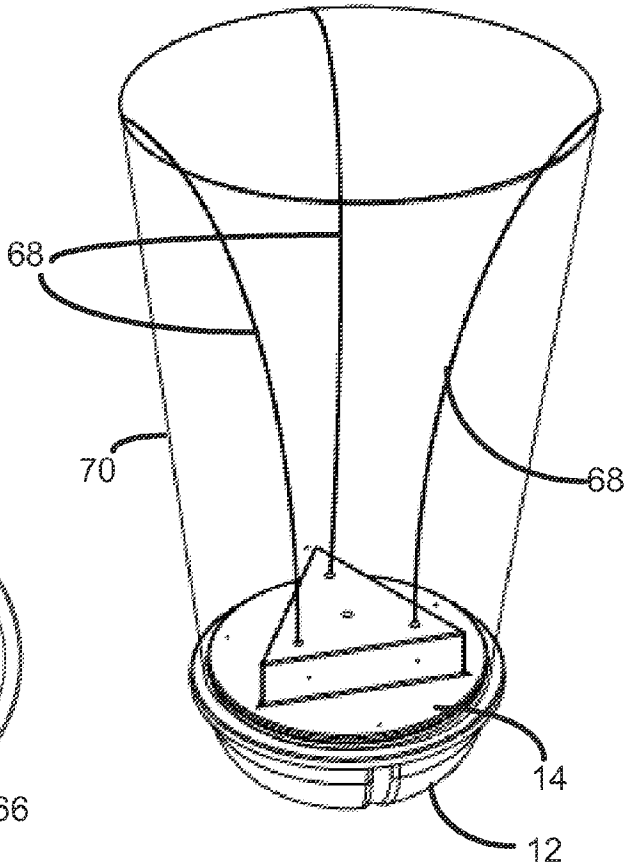
FIG. 7 is a perspective view of the base and cover shown in FIG. 6 with a display attached to the cover.

Once the base 12, cover 14, and anchor-and-tether system 18 have been assembled and installed as shown in FIG. 5, the displays 16 may be added, as shown in FIG. 1. (Alternatively, the displays 16 may be mounted on the cover 14 before securing the cover 14 to the base 12.) In the embodiment shown in FIG. 5, flat panels 16 are secured to the sides of the triangular projection 58 of the cover 14 using the screws 60.

Figure 6:
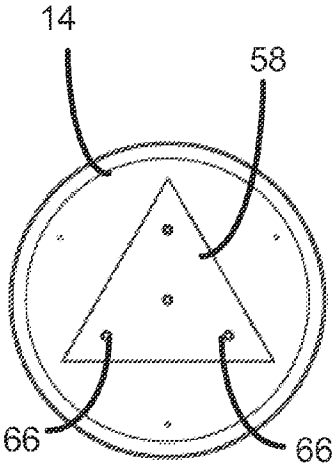
FIG. 6 is a plan view of the base and triangular cover assembly of FIG. 5.
Figure 10:
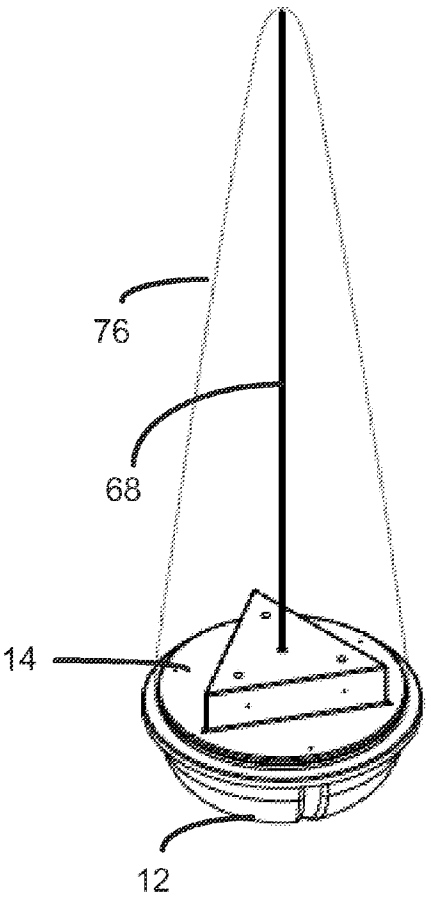
FIG. 10 is a perspective view of still another shape of display mounted on the base and cover of FIG. 6.
Figure 9:
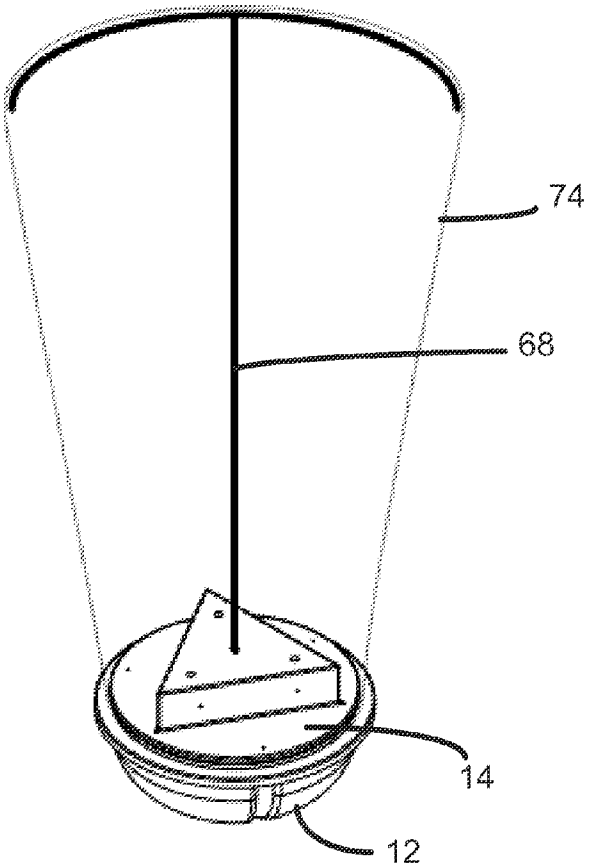
FIG. 9 is a perspective view of the same base and cover as FIG. 6 but with another type of display mounted on the base and cover.
Figure 13:
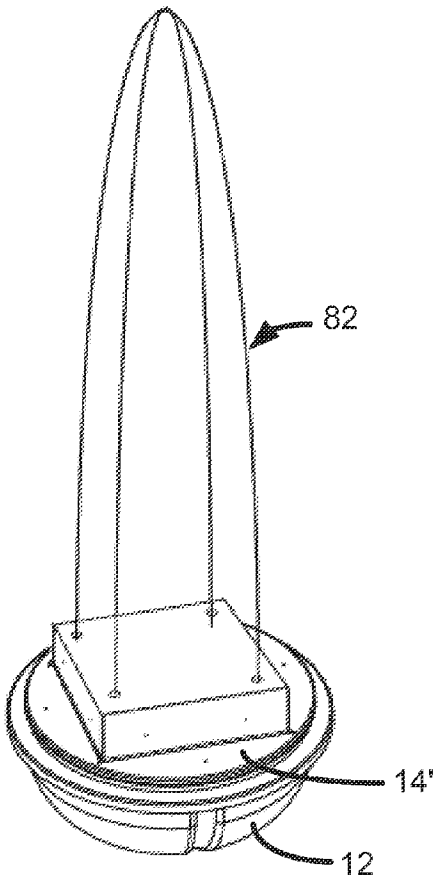
FIG. 13 is a perspective view of another display configuration using the base and cover of FIG. 11.
Figure 12:
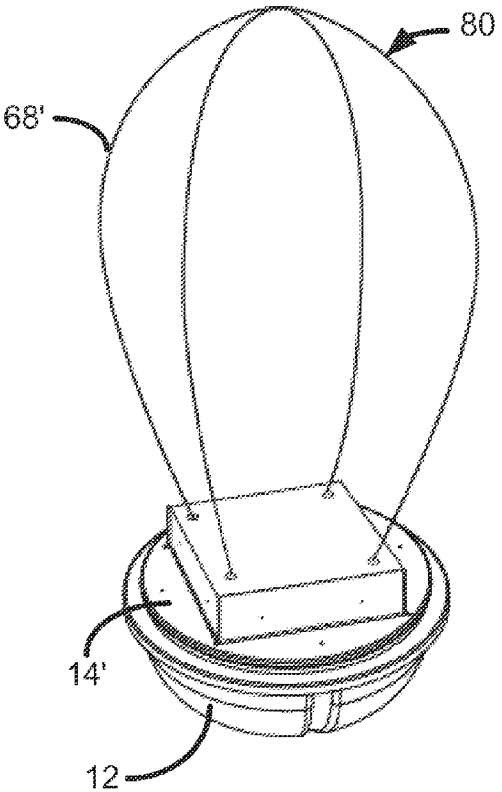
FIG. 12 is a perspective view of a display configuration using the base and cover assembly of FIG. 11.

FIGS. 7-10 show some other configurations of displays which may be displayed using the triangular cover 14 of FIGS. 1 and 6. The triangular projection 58 defines a plurality of vertical recesses 66, each of which may receive a structural wire element 68 (See FIG. 7) to support a frusto-conical display 70 (See FIG. 7), or a divergent inverted pyramidal display 72 (See FIG. 8), or a flattened balloon-shaped display 74 (See FIG. 9), or a conical display 76 (See FIG. 10), or various other shapes of displays, as desired.

Figure 11:
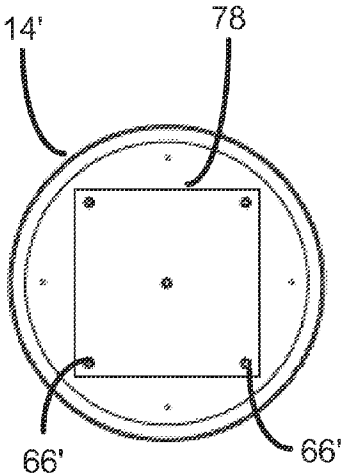
FIG. 11 is a plan view of a base and cover assembly, similar to that of FIG. 6, but with the cover having a rectangular projection.
Figure 15:
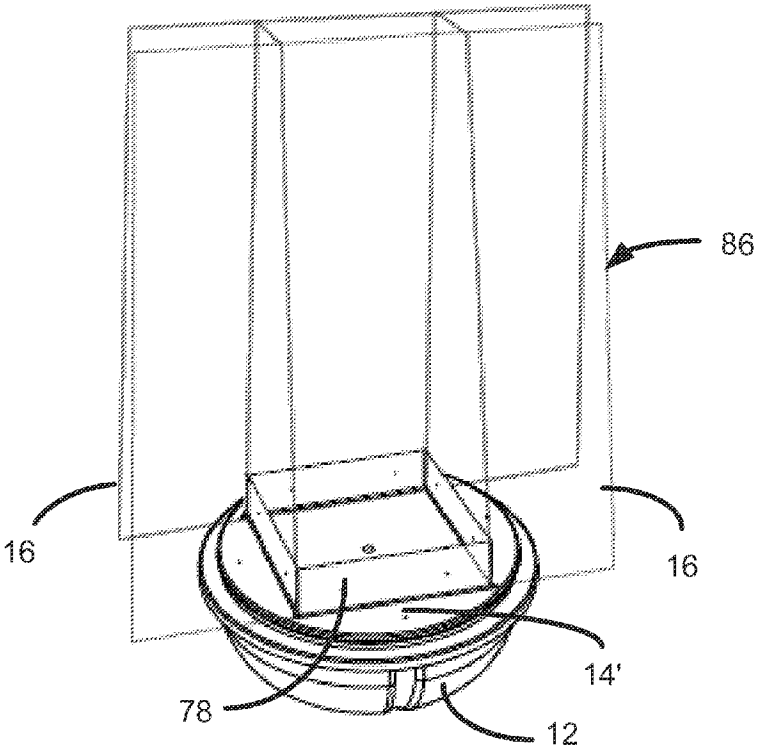
FIG. 15 is a perspective view of another display configuration using the base and cover of FIG. 11.
Figure 14:
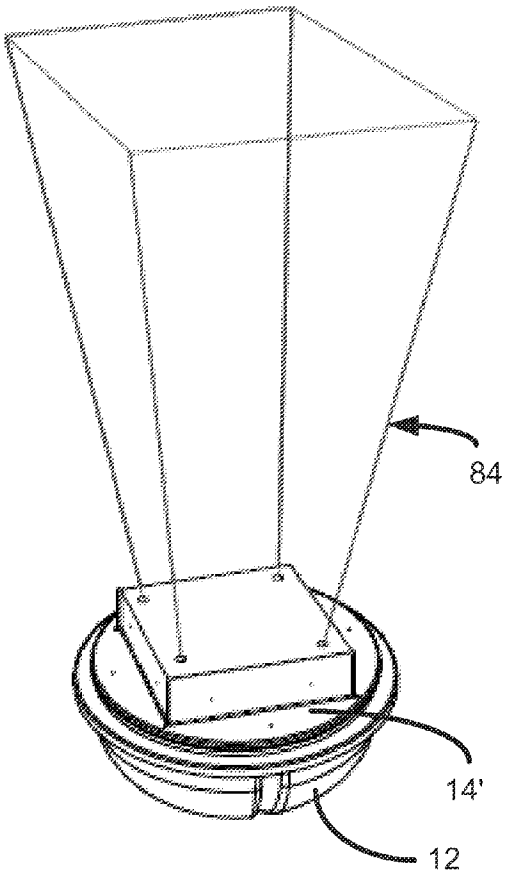
FIG. 14 is a perspective view of another display configuration using the base and cover of FIG. 11.

FIGS. 12-15 show other configurations of displays which may be supported by the rectangular-shaped cover 14' of FIG. 11. The rectangular projection 78 defines a plurality of vertically recesses 66', each of which may receive a structural wire element 68' (See FIG. 12) to support a balloon-shaped display 80 (See FIG. 12), or a pyramidal-shaped display 82 (See FIG. 13), or a divergent-rectangular shaped display 84 (See FIG. 14), or flat panels 16 can be attached to the sides of the rectangular projection 78 to make a sandwich-board display 86 (See FIG. 15).

Figure 18:
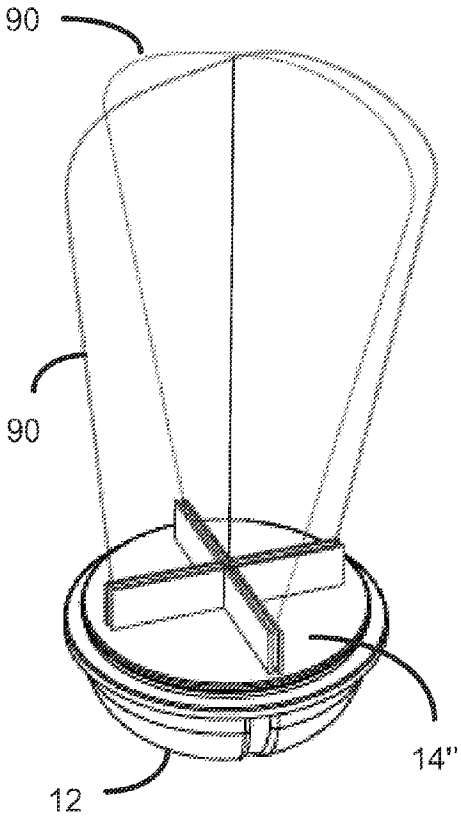
FIG. 18 is a perspective view of another display configuration using the base and cover of FIG. 16.
Figure 17:
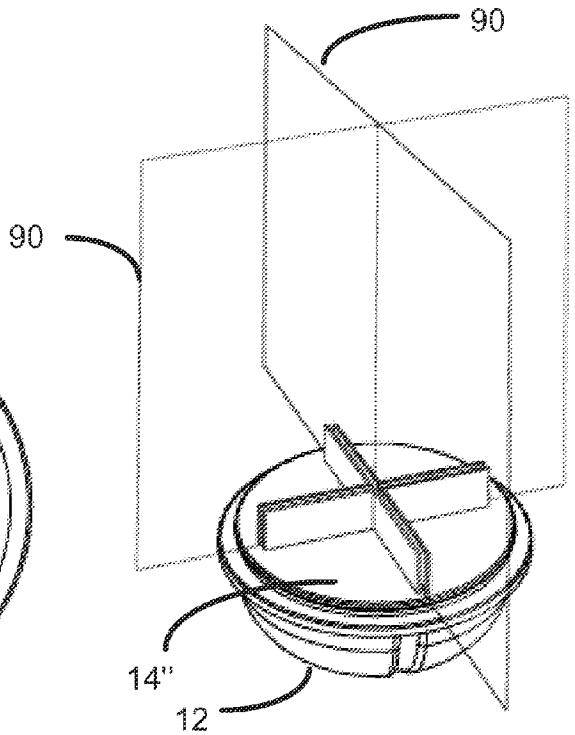
FIG. 17 is a perspective view of a display configuration using the base and cover of FIG. 16.
Figure 16:
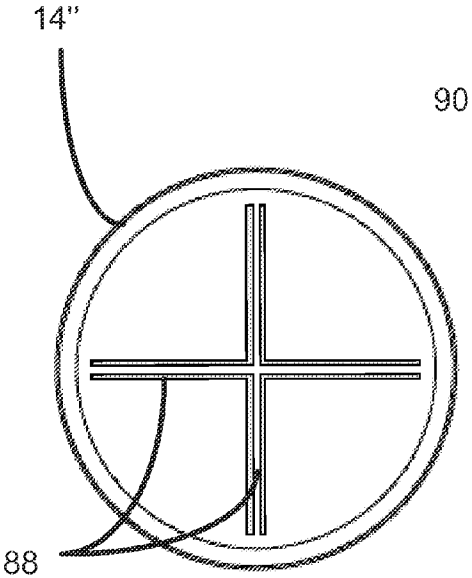
FIG. 16 is a plan view of a base and cover assembly, similar to that of FIG. 6, but with the cover having a cross-shaped projection.

FIGS. 17 and 18 show other configurations of displays which may be displayed using the cross-shaped cover 14" of FIG. 16. The cross-shaped cover 14" defines two intersecting slotted projections 88, each of which receives a flat paneled display 90.

Figures 19, 20, 21:
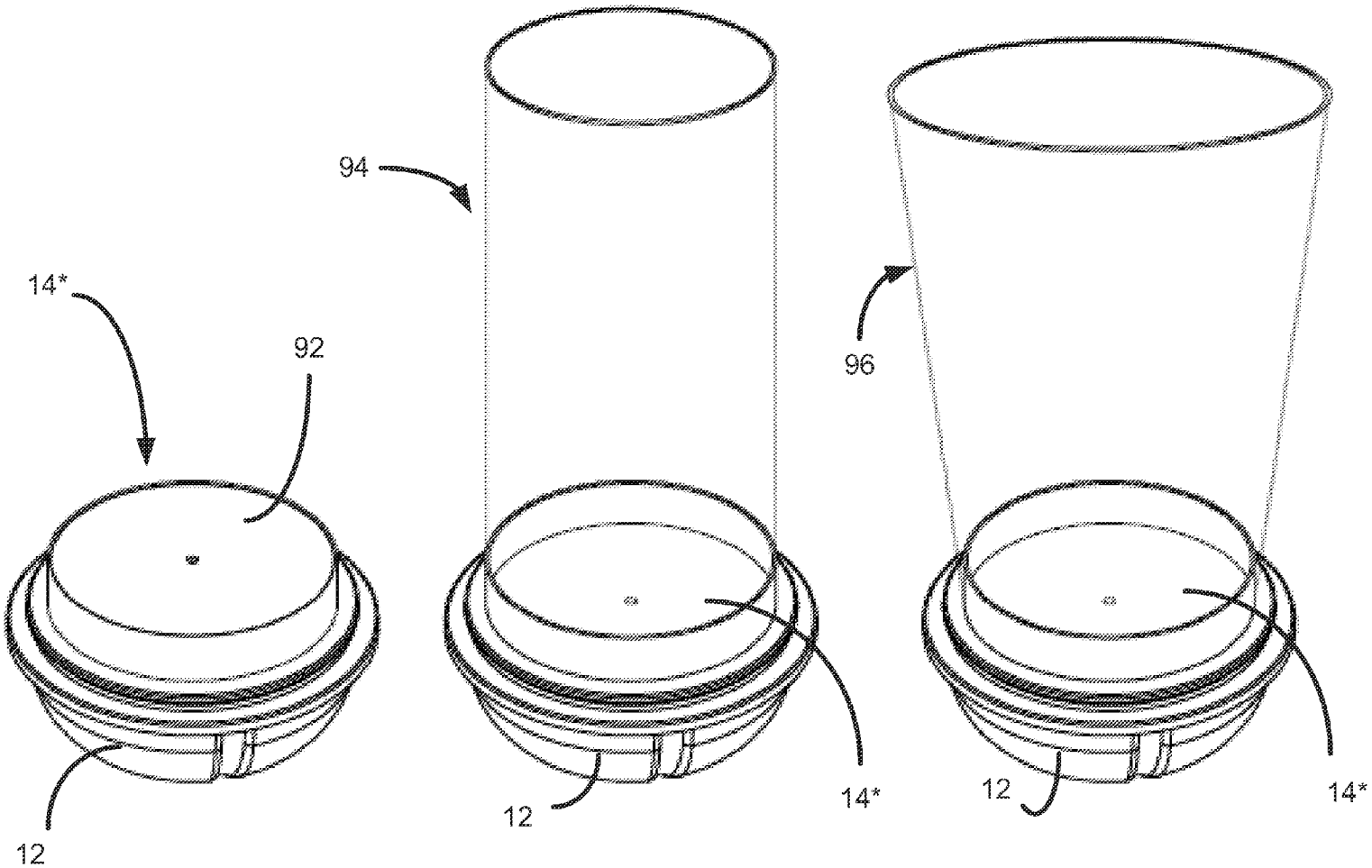
FIG. 19 is a perspective view of a base and cover assembly similar to that of FIG. 6, but with the cover having a cylindrical projection.
FIG. 20 is a perspective view of a display configuration using the base and cover assembly of FIG. 19.
FIG. 21 is a perspective view of another display configuration using the base and cover assembly of FIG. 19.

FIGS. 20 and 21 show other configurations of displays which may be displayed using the cylindrical cover 14* of FIG. 19. The cylindrical projection 92 may be used to secure the base of a vertical cylindrical display 94 (See FIG. 20) or of a divergent cylindrical display 96 (See FIG. 21).

Figure 23:
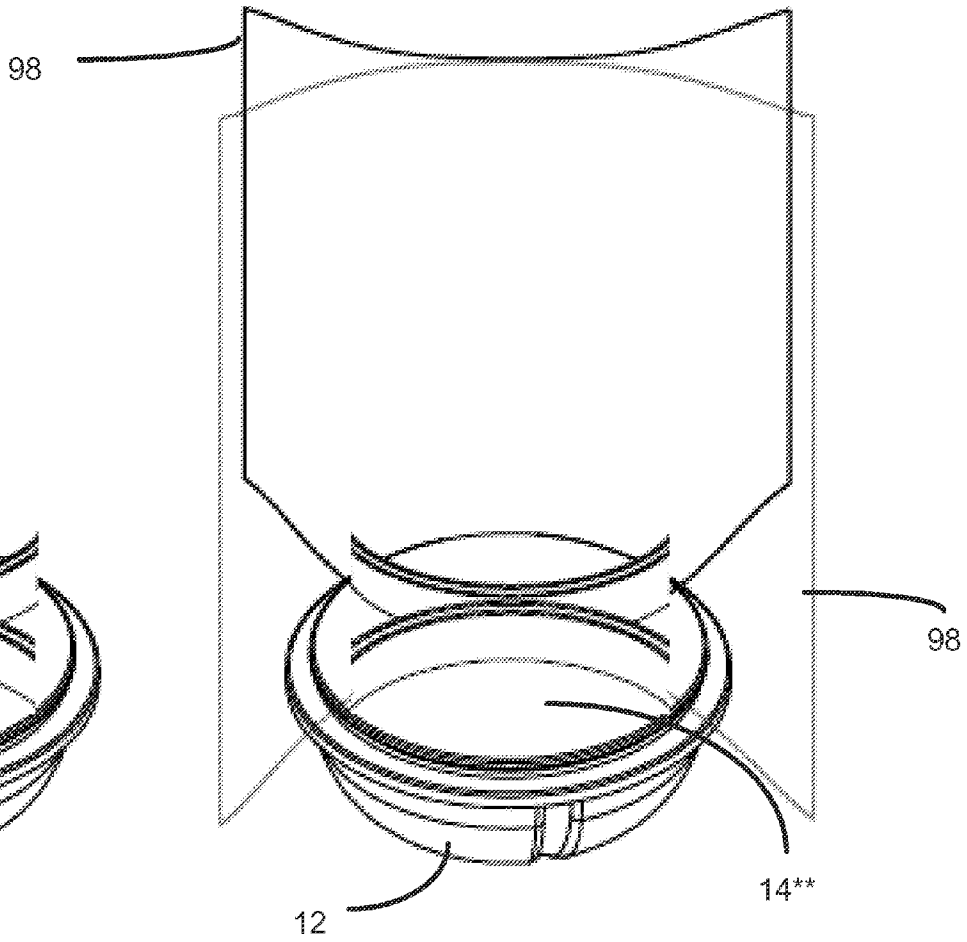
FIG. 23 is a perspective view of a display configuration using the base and cover of FIG. 22.
Figure 22:
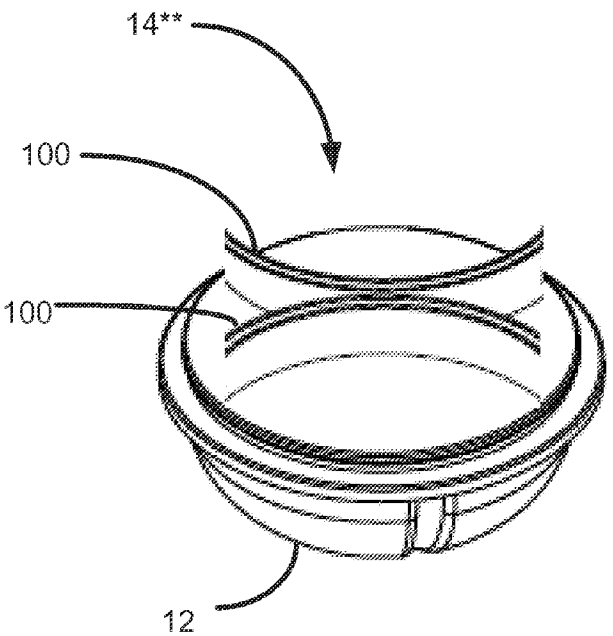
FIG. 22 is a perspective view of another base and cover assembly, similar to that of FIG. 6, but with the cover having divergent arcuate slotted projections.

FIG. 23 shows another configuration of a display which may be displayed using the divergent-slots cover assembly 14 of FIG. 22. The bottom edges of flexible panels 98 are inserted into the divergent slotted projections 100 as shown in FIG. 23**.

Figure 25:
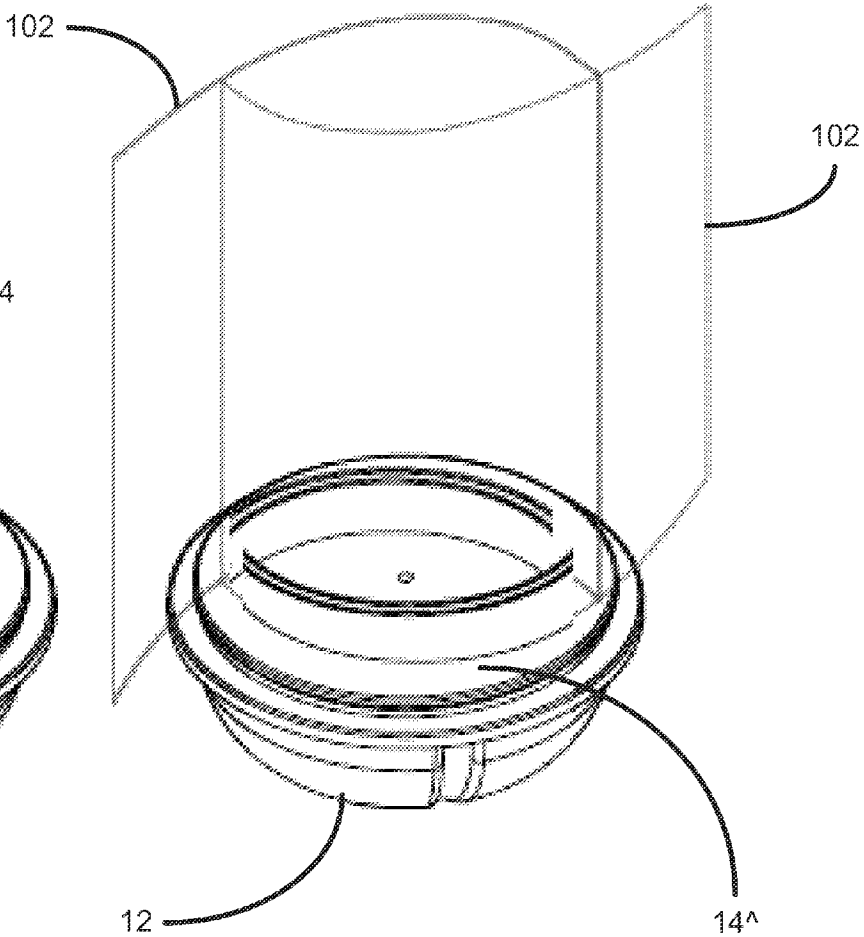
FIG. 25 is a perspective view of a display configuration using the base and cover of FIG. 24.
Figure 24:
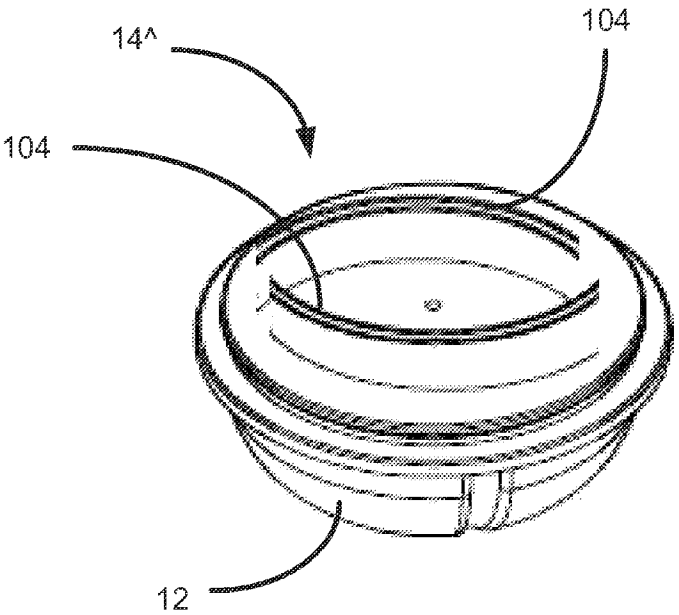
FIG. 24 is a perspective view of a base and cover assembly, similar to that of FIG. 6, but with the cover having convergent arcuate slotted projections.

FIG. 25 shows another configuration of a display which may be displayed using the convergent-slots cover assembly 14^ of FIG. 24. The bottom edges of flexible panels 102 are inserted into the convergent slotted projections 104 as shown in FIG. 25.

Figure 27:
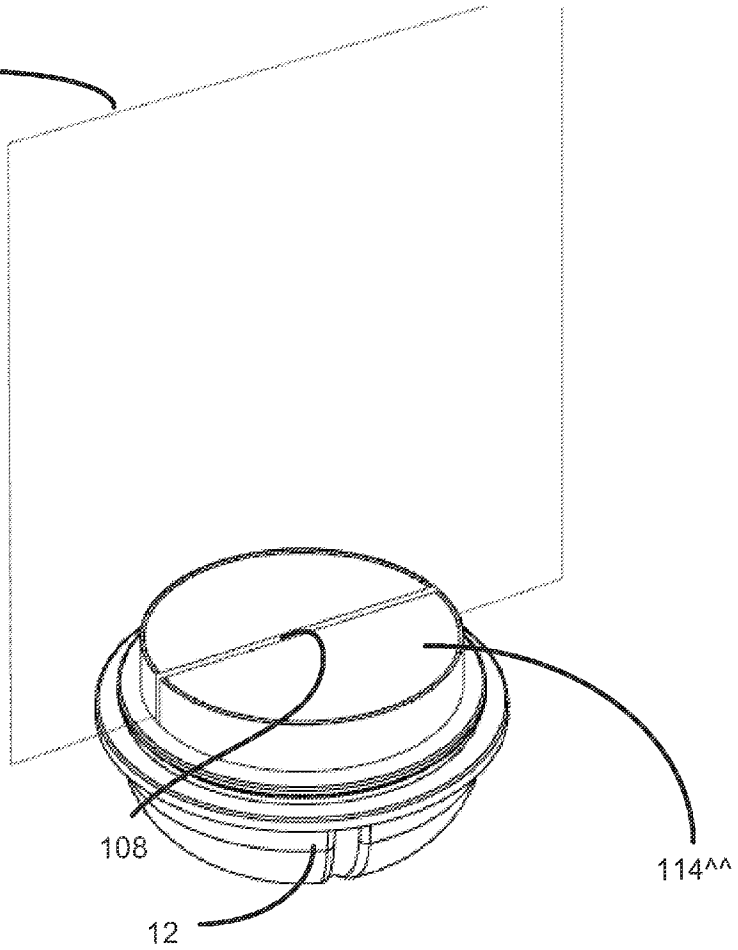
FIG. 27 is a perspective view of a display configuration using the cover and base shown in FIG. 26.
Figure 26:
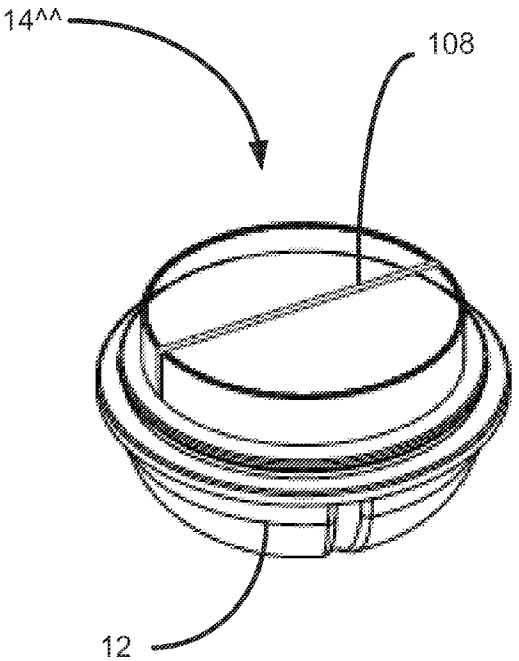
FIG. 26 is a perspective view of a base and cover assembly, similar to that of FIG. 6, but with the cover having a cylindrical projection with a straight-slot.

FIG. 27 shows another configuration of a display which may be displayed using the straight-slot cover assembly 14^^ of FIG. 26. The bottom edge of a panel 106 is inserted into the slotted projection 108 as shown in FIG. 27.

Of course, these are only a few examples of the types of displays that can be supported by this system. Each of these displays will rock in a controlled manner as it is blown by a breeze and the biasing anchor member 22 will apply a force that prevents the display from tipping completely over and then will cause the display to right itself when the breeze stops, without "walking" away from the position of the fixed anchor 20. The tension on the spring 22 urges the display to remain upright and to return to its upright position after it has been "blown over" by a wind gust or by a breeze. The wind, acting on the display panels mounted onto the base 14, may force the base 12 to pivot onto its arcuate side portions 46, against the biasing force of the spring 22. Once the wind relents, the spring 22 brings the display system 10 back to its upright position.

FIG. 30 illustrates the use of a, weighted fixed anchor 110 as well as another embodiment of the display arrangement 10*. It should be noted that this alternate display arrangement 10* may be used instead of the arrangement 10 described earlier, with our without the additional, weighted fixed anchor 110 of FIG. 30. The display system 10* uses the same base 12 and top cover 14 of the display system 10 of FIG. 5. The difference is that this system 10* has a spring 22 connected to upper and lower threaded eyebolts 112, 114 respectively, as best appreciated in FIG. 31.

The upper eyebolt 112 projects through the opening 42 of the frusto-conical recessed wall 44 in the base 12 and is secured to the base via washers 116 and a nut 118 which threads onto the upper eyebolt 112. The upper eyebolt 112 extends beyond the opening 42 and the nut 118 is threaded into the upper eyebolt 112 until the desired degree of tension on the spring 22 is reached. Threading the nut 118 deeper onto the upper eyebolt 112 increases the tension on the spring 22, which makes this anchor-and-tether system a user-adjustable system, with the user being able to regulate the amount of biasing force urging the base into the upright position.

Figure 31:
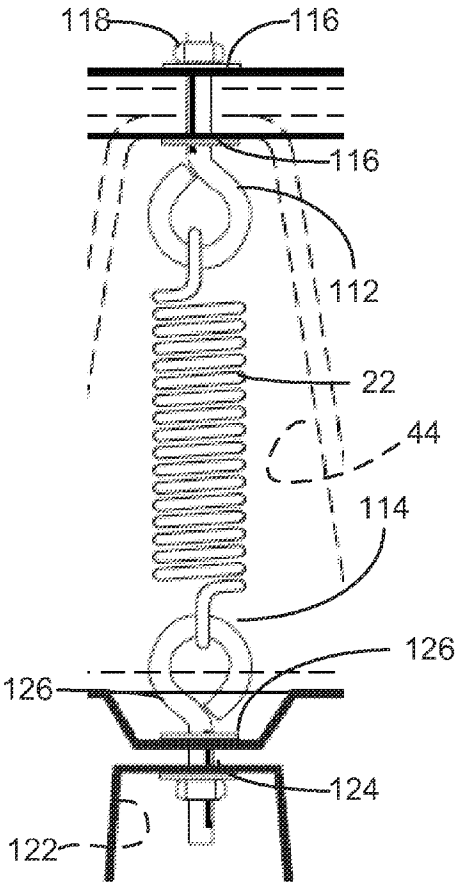
FIG. 31 is an enlarged view of the anchoring mechanism of FIG. 30.

The lower eyebolt 114 projects beyond the substantially flat bottom surface of the base 12 and extends through an opening 120 in a frusto-conical indentation 122 of the fixed anchor 110. The lower eyebolt 114 is secured to the fixed anchor 110 via washers 126 and the nut 124 threaded onto the lower eyebolt 114, as shown in FIG. 31.

The fixed anchor 110 defines substantially flat, horizontal upper and lower surfaces 128, 130 respectively, and a substantially centrally located frusto-conical indentation 122 for securing the lower eyebolt 114 as described above. The fixed anchor 110 is preferably filled either with a flowable solid, such as sand, or with a liquid, such as water, to serve as a weight or ballast to keep the anchor 110 in place. It includes a drain plug 132 to enable the user to empty the contents to facilitate relocation of the display system 10'. When full of ballast, the fixed anchor 110 in this particular embodiment weighs just over 100 pounds.

While a coil spring 22 is used in these embodiments, other types of springs and other types of biasing members could be used instead, such as, for example, a plunger acting against an air cushion.

It will be obvious to those skilled in the art that various other modifications may be made to the embodiments described above without departing from the scope of the invention as claimed.

What is claimed is:

1. A display system, comprising:

a base having a base wall defining a hollow cavity and having a convex bottom surface which includes an arcuately shaped portion to allow the base to rock on a flat ground support surface, said base also having a top edge;

a cover assembled on top of said base and enclosing said hollow cavity; and a biased anchor member for securing said base to a flat ground support surface via a fixed anchor, said biased anchor member being secured to the base and recessed within the base, and said fixed anchor being secured to said biased anchor member and recessed within the base.

2. A display system as recited in claim 1, wherein said convex bottom surface of said base has a central portion with a large radius of curvature which is at least partially surrounded by side portions having a smaller radius of curvature, and wherein said convex bottom surface has a central portion that defines a recess which encloses the biased anchor member.

3. A display system as recited in claim 2, and further comprising a tapered wall that defines said recess and that has a larger diameter at the bottom surface of said base and tapers to a smaller diameter toward the top edge of said base, wherein said biased anchor member is secured to the base adjacent the top edge.

4. A display system as recited in claim 2, and further comprising at least one display attached to said base.

5. A display system as recited in claim 4, wherein said display is attached to said base by a plurality of screws extending through the display and through the cover.

6. A display system as recited in claim 4, wherein said display is attached to said base by at least one structural wire which extends into a recess in the cover and projects away from the cover to support the display.

7. A display system as recited in claim 4, wherein said cover defines at least one slot, and said display is received in said slot.

8. A display system as recited in claim 2, wherein said recess also encloses the fixed anchor.

9. A display system as recited in claim 8, and further comprising a tapered wall that defines said recess and that has a larger diameter at the bottom surface of said base and tapers to a smaller diameter toward the top edge of said base, wherein said biased anchor member is secured to the base adjacent the top edge.

10. A display system as recited in claim 8, and further comprising at least one display attached to said base.

11. A display system as recited in claim 10, wherein said display is attached to said base by a plurality of screws extending through the display and through the cover.

* * * * *